United States Patent [19]

Robinson et al.

[11] Patent Number: 4,743,201

[45] Date of Patent: May 10, 1988

[54] MOVEABLE ELECTRICAL CONTACT PLUNGER

[75] Inventors: Walter E. Robinson; Anthony W. Lumbis, both of Watertown, N.Y.

[73] Assignee: General Signal Corporation, Stamford, Conn.

[21] Appl. No.: 47,095

[22] Filed: May 8, 1987

[51] Int. Cl.[4] ..... H01R 39/00

[52] U.S. Cl. ..... 439/10; 439/29; 439/819; 439/824; 439/877

[58] Field of Search ..... 439/1, 6, 10, 11, 13, 439/18, 29, 30, 32, 33, 136, 137, 138, 289, 293, 482, 483, 816, 819, 820, 824, 839, 840, 841, 877, 879

[56] References Cited

U.S. PATENT DOCUMENTS

| | | | |
|---|---|---|---|
| 1,390,607 | 9/1921 | Farmer | 439/289 |
| 2,091,470 | 8/1937 | Douglas | 439/816 |
| 2,287,499 | 6/1942 | Smith | 439/33 |
| 2,811,691 | 10/1957 | Dahm et al. | 439/482 |
| 3,032,735 | 5/1962 | Dingman | 439/30 |
| 3,439,307 | 4/1969 | Ruscher | 439/29 |
| 3,573,722 | 4/1971 | DeLano | 439/824 |

FOREIGN PATENT DOCUMENTS

| | | | |
|---|---|---|---|
| 1234612 | 10/1960 | France | 439/13 |

*Primary Examiner*—Gil Weidenfeld
*Assistant Examiner*—David Pirlot
*Attorney, Agent, or Firm*—Robert R. Hubbard; Milton E. Kleinman

[57] ABSTRACT

A moveable contact plunger assembly for interconnection of electrical wires between adjacent railway cars. The assembly has a plunger with a shoulder which fits in abutment with a mating shoulder in an aperture of a dielectric connector block. A follower element is arranged for electrical contact with the plunger. A spring is arranged to allow axial deflection of the plunger relative to the follower element and of the follower element relative to the dielectric block shoulder. Electrical continuity between the plunger and the follower element is obtained by means of a wire which is crimped to the follower and to the plunger. A guide pin mounted on the follower element and a guide slot on a spring barrel portion of the plunger coact with the spring so as to allow axial travel of the follower and of the plunger as well as a rotating motion of the plunger during its axial travel.

4 Claims, 1 Drawing Sheet

MOVEABLE ELECTRICAL CONTACT PLUNGER

BACKGROUND OF INVENTION

This invention relates to electrical couplings and in particular to moveable contact plunger assemblies which are useful in the electrical coupling of railway or transit cars.

The interconnection of electrical wires from one rail car to the next is achieved by means of connectors arranged in dielectric blocks which are forced together as by clamping. In one transit car design, electrical contact from one wire to another is achieved by means of a butt fit between a moveable contact plunger in one block and a stationary contact pin in the other block at the connection interface.

The system requirements are that the moveable contact plunger be (1) moveable axially so as to forcefully provide the butt fit and (2) be rotatable during axial motion so as to wipe contaminants from the mating surfaces. A further requirement of the system is that the follower of the moveable contact plunger assembly which projects from the other side of the dielectric connector block also be moveable for axial travel so as to provide a force fit with a further connector to the rail car side of the connection interface.

One prior art plunger assembly complying with these requirements consisted of a cylindrical contact plunger with a shoulder that fits in abuttment with a mating shoulder in the aperture of the dielectric block. The plunger terminates at one end in a screw thread area arranged to loosely mate with screw threads carried in a follower element. A spring is arranged concentric with the screw thread area and is seated between a flange at one end of such area and the follower element. The threaded relationship and the spring allows the follower and pin to satisfy the axial travel as well as the rotatable plunger requirements.

Electrical continuity achieved via the loose threading arrangement is rather poor because of a reliance on compressive forces to achieve electrical contact. To compensate the spring is made of a copper alloy so as to provide an additional low resistance current path. These prior art plunger assemblies, though workable, experienced a high failure rate due to over heating of the springs which resulted in tempering and deformation of the spring length and spring rate. This was caused by currents in excess of 75 amperes under worse case as, for example, when a car is connected to a car that has a dead battery so as to present negligible inpedance (short circuit).

Heretofore, attempts to provide moveable contact plunger assemblies with improved failure rate have been unsatisfactory in that they do not comply with the aforementioned contact plunger assembly requirements. One such design employed a solid metallic cylinder extending from the contact pin toward the follower element. This design had the disadvantages of (1) lack of plunger or contact pin rotation, (2) reliance upon compressive force for electrical contact of the cylinder with the follower element and (3) susceptibility to contaminants entering the contact area.

Another design employed a braided wire that was crimped in the plunger contact pin and further attached to the plunger body by screw threads. The same screw threads also served for attachment of the follower element. This design, however, does not provide for plunger rotation and further does not provide for axial deflection of the follower.

BRIEF SUMMARY OF THE INVENTION

An object of this invention is to provide a novel and improved moveable contact plunger assembly for interconnecting the electrical wires of one railway car to another.

Another object is to provide a moveable contact plunger assembly that can operate for long periods of time without failure in railway car environments.

Yet another object is to provide a moveable contact plunger assembly in which electrical continuity is obtained by means of crimped contacts.

A moveable contact plunger assembly embodying the present invention has a plunger with a shoulder which fits in abuttment with a mating shoulder in an aperture of a dielectric connector block. A follower element is arranged for electrical contact with the plunger. A spring is arranged to allow axial deflection of the plunger relative to the follower element and of the follower element relative to the dielectric block shoulder. The improvement according to the invention is provided as follows. The plunger has a contact pin, a hollow crimping area and a spring barrel. A braided wire is crimped at one end in the crimping area of the plunger and connected at the other end to the follower element so as to provide electrical continuity between the plunger and the follower element. The follower element and the spring barrel are arranged with the spring to allow axial deflection of the follower element relative to the dielectric block.

To provide the axial deflection, the spring is seated in the spring barrel concentric with the braided wire. The spring barrel is provided with a guide slot arranged along its surface. The follower element has a guide pin arranged for travel in the guide slot so as to allow axial deflection of the plunger relative to the follower element and of the follower element relative to the dielectric block shoulder. To impart rotating motion to the plunger during such axial travel, the guide slot is arranged in a helical path on the surface of the spring barrel.

BRIEF DESCRIPTION OF THE DRAWINGS

In the accompanying drawings like reference characters denote like elements of structure

DESCRIPTION OF PREFERRED EMBODIMENT

Figure 1:
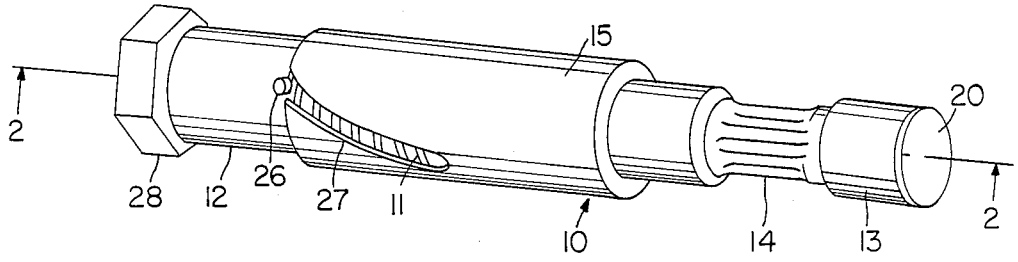
FIG. 1 is a perspective view of a moveable contact plunger assembly embodying the present invention.
Figure 2:
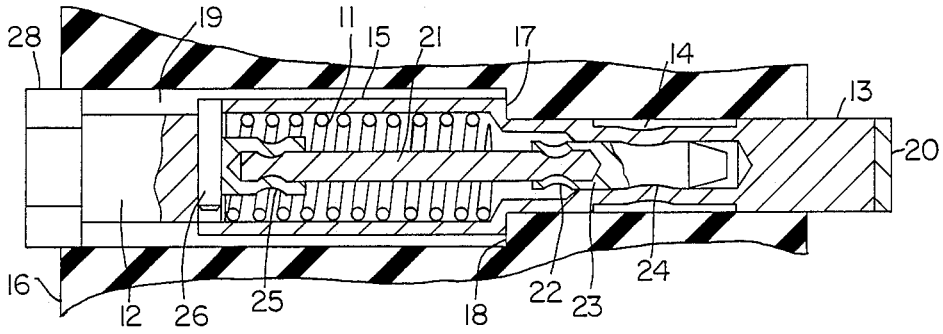
FIG. 2 is a cross sectional view of such assembly taken along the lines 2—2 of FIG. 1 as further illustrated in a partial cross section of a dielectric connector block.

Referring now to FIGS. 1 and 2, a moveable contact plunger assembly embodying the invention includes a plunger 10, a spring 11 and a follower element 12, all of which are metallic. The plunger 10 has a contact pin 13, a crimp area 14 and a spring barrel 15. The plunger 10 is solid at the contact pin 13 but is hollow beginning in the crimp area 14 and extending entirely through the spring barrel 15.

As shown in FIG. 2, the moveable contact plunger assembly is adapted for mounting in an aperture 19 of a dielectric connector block 16. The plunger 10 has a shoulder 17 formed at right hand extremity of the spring barrel which fits against a mating shoulder 18 contained within the aperture 19 of the dielectric block. This serves as a stop which limits motion of the plunger to the right. In serving as a connector interface between two rail cars, the contact pin 13 will mate in a butt relation with a stationary contact pin (not shown in a similar dielectric connector block to the right of the block 16, but not shown for the sake of convenience.) The two blocks are then forced together as by means of a clamp (not shown) to form the butt contact. To provide a good electrical contact, the contact pin 13 is plated with a silver alloy 20.

To provide electrical continuity between the contact pin 13 and the follower 12, a wire connector 21 is provided. The wire connector 21 is crimped at 22 to a metallic extender 23 which in turn is crimped at 24 to the crimping area 14 of the contact pin 13. At its other end, the wire connector 21 is crimped at 25 to the follower element 12. The wire connector 21 may take any suitable form, but is preferably a braided wire.

The spring 11 is seated in the spring barrel 15 between its right hand extremity and the right hand edge of the follower element 12. Since the spring is not expected to carry electrical current, it can be, and preferably is, formed of stainless steel so as to withstand higher temperatures. The length of the wire 21 is such that the spring is slightly compressed after the wire extender crimped at 24.

The follower element 12 has a hexagonal nut 28 at its left extremity. The dielectric block aperture 19 is also hexagonal in shape so as to receive the nut 28 in a snug fit and prevent any rotational motion of the follower. The aperture hexagonal shape extends to the shoulder 18. The aperture shape is circular to the right of the shoulder so as to mate snugly with the circular shape of the contact pin 13.

The follower element 12 has a guide pin 26 which is arranged for travel in a guide slot 27 formed in the surface of the spring barrel 15. The guide pin 26, for example, may be formed by means of a dowel as best seen in FIG. 2. This travel is caused by a compressive force which can be applied either to the follower element 12 or to the contact pin. Such a force is applied to the follower element 12 upon installation when it is fitted against a mating stationary connector. This fitting process involves moving the follower element axially to the right, thereby compressing the spring further.

A force is applied to the contact pin 13 at the time of the interconnection to an adjacent rail car. The dielectric blocks of each rail car are forced together as by clamping. This causes a compressive force to be applied axially to the left on the contact pin 13 so that the plunger 10 moves to the left, thereby compressing the spring further.

The guide slot 27 preferably follows a helical path on the surface of the spring barrel 15 so as to impart a rotating motion to the plunger 10 and its contact pin 13 as the compressive force is applied during the interconnect operation. This rotating motion provides a wiping function as the surface 20 mates with its corresponding surface of the stationary pin so as to wipe away contaminants.

It is possible that in some applications the wiping action will not be required. In such applications, the guide slot could follow a straight line path in the axial direction. Alternatively, both the guide slot and guide pin can be elimnated for this case. This will eliminate the rotating action of the plunger but will preserve the ability of the follower 12 and of the plunger 10 to both travel in the axial direction in response to compressive forces applied at their respective ends.

From the preceding description of the preferred embodiment it is evident that the objects of the present invention are attained and that a novel and improved moveable contact plunger assembly is provided which has a long life electrical connection between its ends that is relatively immune to contaminants. Although the invention has been described and illustrated in detail it is clearly understood that the same is by way of illustration and example only and is not to be taken by way of a limitation. For example, the guide slot may either assume the helical path illustrated in the drawing for the rotating case or a straight line path or even be eliminated for those applications which do not require a rotating plunger. The spirit and scope of the present invention are to be limited only by the terms of the appended claims.

What is claimed is:

1. A moveable contact plunger assembly having a plunger with a shoulder which fits in abuttment with a mating shoulder in an aperture of a dielectric connector block, a follower element arranged for electrical contact with the plunger and a spring arranged to allow axial deflection of the plunger relative to the follower element and of the follower element relative to the dielectric block shoulder, the improvement which comprises:

the plunger having a contact pin, a hollow crimping area and a spring barrel;

a wire crimped at one end in the crimping area of the plunger and connected at the other end to the follower element so as to provide electrical continuity between the plunger and the follower element; and the follower element and the spring barrel being arranged with the spring to allow axial deflection of the follower element relative to the dielectric block.

2. The invention according to claim 1.

wherein the spring is seated in the spring barrel concentric with the wire;

wherein the spring barrel has a guide slot arranged along its surface; and wherein the follower element has a guide pin arranged for travel in the guide slot to allow the axial deflection of the plunger and of the follower element.

3. The invention according to claim 2.

wherein the guide slot follows a helical path on the surface of the spring barrel so as to impart a rotating motion to the plunger upon application of compressive force to the contact pin.

4. The invention according to claim 3 wherein the wire is a braided wire.

* * * * *